United States Patent [19]

Cassity et al.

[11] Patent Number: 4,862,426

[45] Date of Patent: Aug. 29, 1989

[54] METHOD AND APPARATUS FOR OPERATING EQUIPMENT IN A REMOTE LOCATION

[75] Inventors: Thomas G. Cassity, Katy; William C. Montgomery, Sugar Land; Gerald S. Baker, Houston; Alfred W. Wedel, Houston; William M. Taylor, Houston, all of Tex.

[73] Assignee: Cameron Iron Works USA, Inc., Houston, Tex.

[21] Appl. No.: 130,244

[22] Filed: Dec. 8, 1987

[51] Int. Cl.[4] ..... G01V 1/40

[52] U.S. Cl. ..... 367/81; 166/336; 166/335

[58] Field of Search ..... 166/335, 336, 338, 341, 166/339, 340; 367/4, 134, 910, 81, 82; 181/110, 101, 402; 340/853, 860

[56] References Cited

U.S. PATENT DOCUMENTS

| | | | |
|---|---|---|---|
| 3,513,911 | 5/1970 | Petersen | 166/338 |
| 3,813,656 | 5/1974 | Fowler . | |
| 3,820,389 | 6/1974 | Richter, Jr. et al. . | |
| 3,821,696 | 6/1974 | Harrell et al. . | |
| 3,825,078 | 7/1974 | Heilbecker et al. . | |
| 3,900,827 | 8/1975 | Lamel et al. . | |
| 3,949,354 | 4/1976 | Claycomb . | |
| 3,958,217 | 5/1976 | Spinnler . | |
| 3,982,224 | 9/1976 | Patton . | |
| 4,001,775 | 1/1977 | Sexton et al. . | |
| 4,066,995 | 1/1978 | Matthews . | |
| 4,087,781 | 5/1978 | Grossi et al. . | |
| 4,121,193 | 10/1978 | Denison . | |
| 4,126,848 | 11/1978 | Denison . | |
| 4,134,100 | 1/1979 | Funke . | |
| 4,206,810 | 6/1980 | Blackman | 166/336 |
| 4,300,637 | 11/1981 | Valka | 166/336 |
| 4,337,829 | 7/1982 | Banzoli et al. | 166/336 |
| 4,527,425 | 7/1985 | Stockton . | |

*Primary Examiner*—Thomas H. Tarcza
*Assistant Examiner*—Ian J. Lobo

[57] ABSTRACT

An improved method and apparatus for operating or setting equipment within a subsea marine wellhead from the surface having an indicating signal provided at the surface of the successful completion of such operation. The steps of the method include the lowering of a well component and the detecting and transmitting equipment on a running string from the surface; detecting the successful completion of the subsea operation, and transmitting to the surface of a signal signifying that the operations within the subsea well head have been successfully completed. The apparatus includes the running string, the detecting means which may be an acoustic detector or a ferrous metal detector or other suitable detector, a signal transmitter, means for supporting the detector and transmitter on the running string so that the well component can be properly lowered and positioned within the subsea wellhead and its proper landing, sealing or latching or other desired condition signalled to the surface to provide an indication that the operation has been completed.

29 Claims, 11 Drawing Sheets

METHOD AND APPARATUS FOR OPERATING EQUIPMENT IN A REMOTE LOCATION

BACKGROUND

The operation of equipment in remote and inaccessible locations is difficult and, at time, impossible since there is no information available as to the condition or the occurrence of an event in such remote location. A typical example of a remote and inaccessible location is a subsea marine wellhead. The operations in a subsea marine wellhead are numerous and difficult to determine by the operations on the drilling vessel whether or not the exact desired operation has been successful. Examples of the kinds of operations contemplated herein are the landing of a casing hanger on the housing seat, the proper setting of the annulus seal, the positioning of a tool or component at a particular level or orientation within the wellhead, the strain on a component within the wellhead as an indication of the completion of a downhole cold forging operation or merely the application of a preselected amount of torque or other load to a component within the wellhead.

Prior to the present invention, the operations contemplated herein were done from a drilling vessel at the surface of the water and either no indications or very limited indications have been available as to whether or not such operations have been successfully completed. The penalty for failure of completion of such operations successfully has been at least having to recover the string and other equipment to the surface and to redo the operation completely, usually with new equipment. Failure to complete some operations can result in damage to the wellhead and possible other damage to the well.

While well logging has for years been accomplished in well bores both on land in marine applications, the information was normally transmitted back to the surface electrically by direct wiring or recorded by the tool in the well bore and the tool recovered to the surface. The information which such devices have acquired is not helpful in providing the desired completion of operations information which is desired.

Some information has been provided from a well bore for directional drilling purposes but this information is generally an indication of the direction and inclination taken by the drilling tool during directional drilling operations. Such information did not provide any signal which would be sufficiently complete for any operations other than the controlling of the direction of the drilling.

There has been a considerable amount of work on systems and apparatus for use to make measurements while drilling. These measurements include transmitting information, such as logging data and transmitting to the surface on longitudinal and torque pulses in the drill string (U.S. Pat. Nos. 3,813,656 and 3,830,389; utilizing an acoustic signal transmitted through the drill string U.S. Pat. Nos. (3,900,827 and 4,066,995); generating mud pulses and transmitting through the drilling fluid (U.S. Pat. Nos. 3,958,217, 4,001,775, 4,134,100, 3,821,696, 3,949,354 and 3,982,224); sonic signals detect change in mud flow rate from drill string to annulus (U.S. Pat. No. 4,527,425); information electrically transmitted to the surface over wires (U.S. Pat. Nos. 3,825,078, 4,121,193 and 4,126,848); well logging information transmitted in the range from 1–30 Hertz and includes repeater stations (U.S. Pat. No. 4,087,781); and pressure pulses generated in the string and detected at the surface as stress changes in the material of the drill string wall (U.S. Pat. No. 4,066,995).

As can be seen from a review of such prior art references, none of them address the problem of providing information to the surface to indicate the position of equipment being used within a subsea wellhead in a marine well.

SUMMARY

The present invention relates to an improved method and apparatus for operating or setting equipment within a subsea marine wellhead from the surface and having an indicating signal provided at the surface of the successful completion of such operation. The steps of the method include the equipment setting or operating at the surface which are intended to perform an operation within the subsea wellhead, detecting the successful completion of the subsea operation, and transmitting to the surface a signal signifying that the operations within the subsea wellhead have been successfully completed. The present invention is also applicable to any application in which equipment is operated at a remote inaccessible location by manipulation at an accessible location and providing a signal to indicate that the desired position of the equipment has been achieved or that the event desired has occurred. It is contemplated that the improved method and apparatus of the present invention is applicable to operations of underwater Xmas trees, marine production manifolds, underwater pipeline repairs, underwater laying of pipelines, remote leak detection, remote choke and valve positioning, remote flow rate detection, remote annular and ram type blowout preventer positioning and other details in the positioning and operation of remote equipment. The apparatus includes the equipment to perform the method as hereinafter described.

An object of the present invention is to provide an improved method and apparatus for operating or setting equipment within a subsea marine wellhead from the surface which provides an indication at the surface of the positive completion of the operation or setting of the equipment within the wellhead.

Another object is to provide an improved method and apparatus for operating equipment within a subsea marine wellhead which ensures that the failure of proper operation or setting of the equipment within the wellhead is known substantially upon completion of the surface operations.

A further object is to provide an improved method and apparatus for operating equipment in a subsea marine wellhead which avoids problems encountered with using improperly set wellhead components.

A still further object is to provide an improved method and apparatus for operating equipment in a remote, inaccessible location by manipulation of equipment at an accessible location and giving a signal of the assumption of the desired position or the occurrence of the desired event.

BRIEF DESCRIPTION OF THE DRAWINGS

These and other objects of the present invention are hereinafter set forth and explained with reference to the drawings wherein.

DESCRIPTION OF THE PREFERRED EMBODIMENTS

Figure 1:
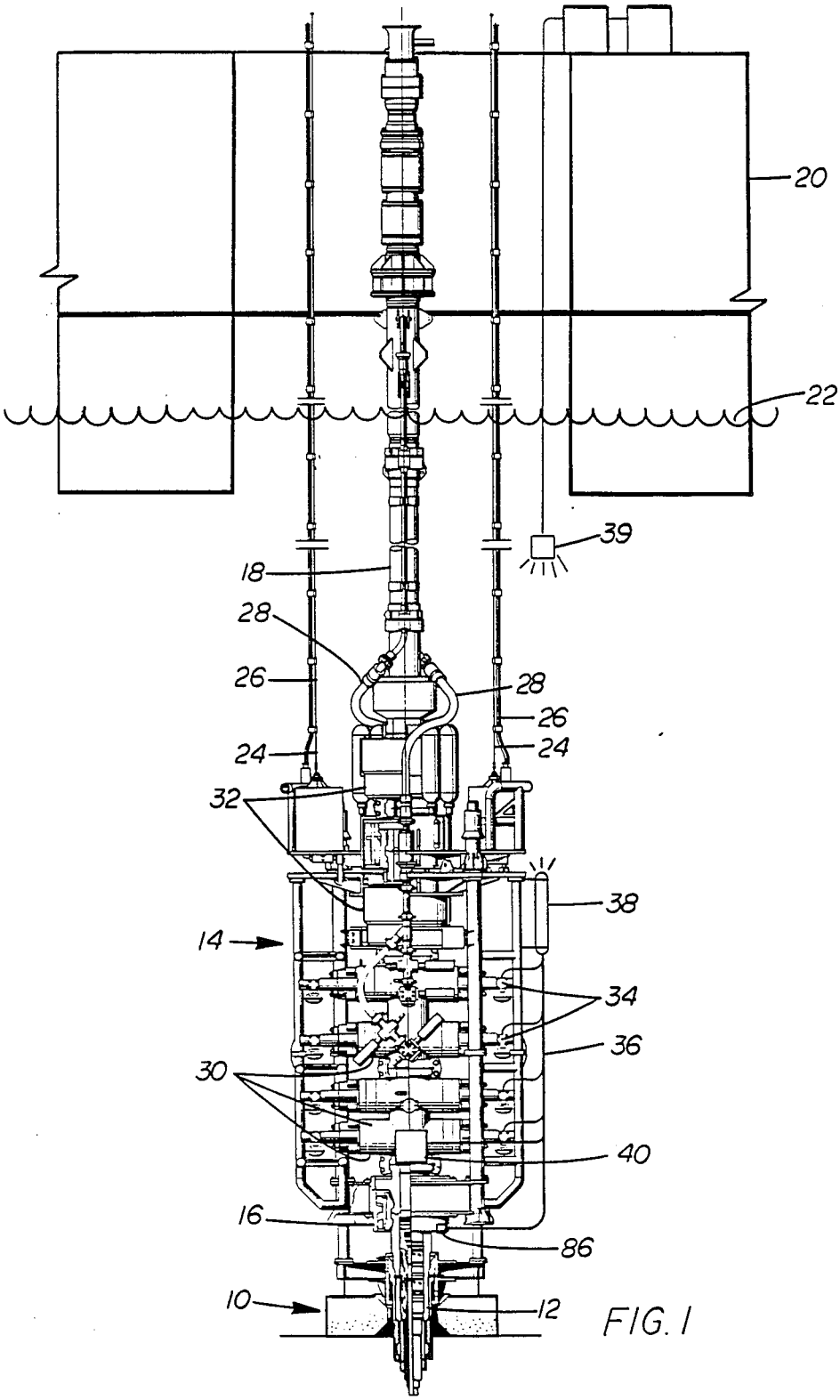
FIG. 1 is a schematic elevation view of a subsea marine completion of proper setting or location of equipment within the subsea wellhead.

Wellhead 10 shown in FIG. 1 is a subsea marine wellhead and has housing 12 to which stack 14 is connected by remotely actuated collet connector 16. Riser 18 connects from the upper end of stack 14 to floating structure 20 at water surface 22. Mechanical guide cables 24 also extend from stack 14 to floating structure 20 and wiring bundles 26 are secured to guide cables 24 to connect between structure 20 and stack 14 to provide control of stack 14. Choke and kill lines 28 extend upward along the exterior of riser 18. Stack 14 includes a plurality of ram type blowout preventers 30 and upper annular blowout preventer 32. Sensing means 34 are provided in one of the tailstocks of each of preventers 30 for sensing the position of the rams in the preventers and lines 36 extend from such sensing means 34 to transmitter 38 which is mounted at the upper end of stack 14 and offset to the side thereof as shown. Also, sensing means 40 is mounted in the choke and kill connection of the lower preventer 30 and line 42 extends from sensing means 40 to transmitter 38. Transmitter 38 is shown to be a sonar transmitter which receives data through lines 36 and 42 and transmits such data through the sea water to receiver 39 suspended in the water below structure 20 and preferably at a position substantially aligned and above transmitter 38.

Figure 2:
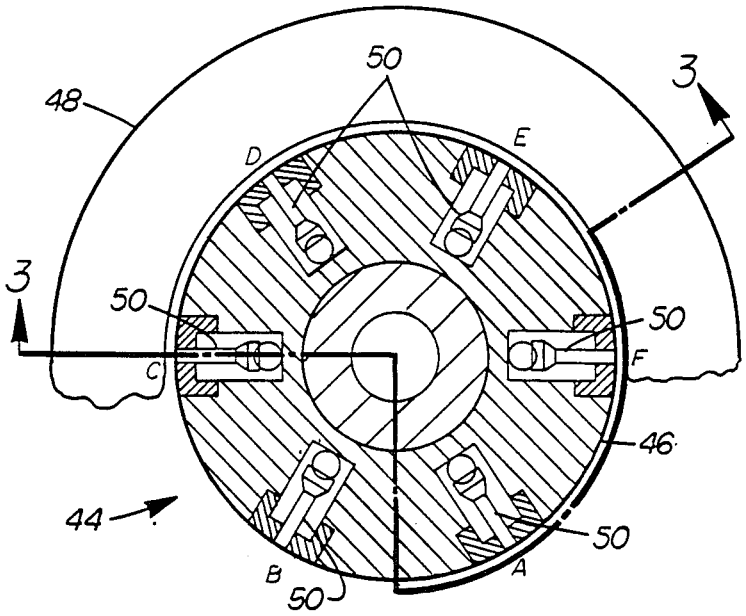
FIG. 2 is a schematic transverse sectional view of a proximity location detection sub with the section being taken through each individual proximity detector to illustrate its location with respect to the circumference of the others around the sub.
Figure 3:
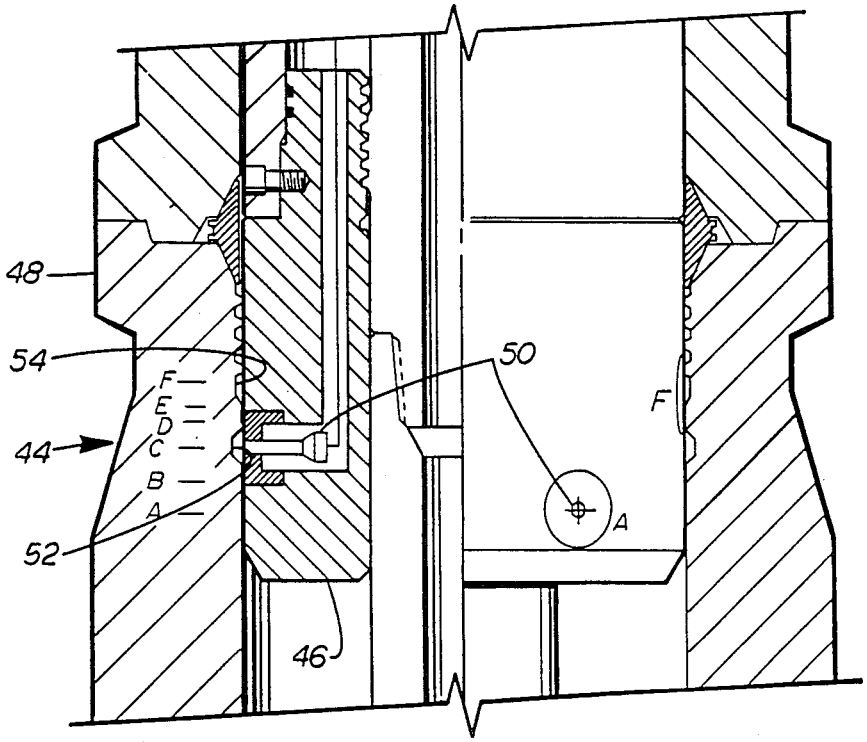
FIG. 3 is a longitudinal sectional view of the detection sub shown in FIG. 2 taken along line 3—3.
Figure 4A:
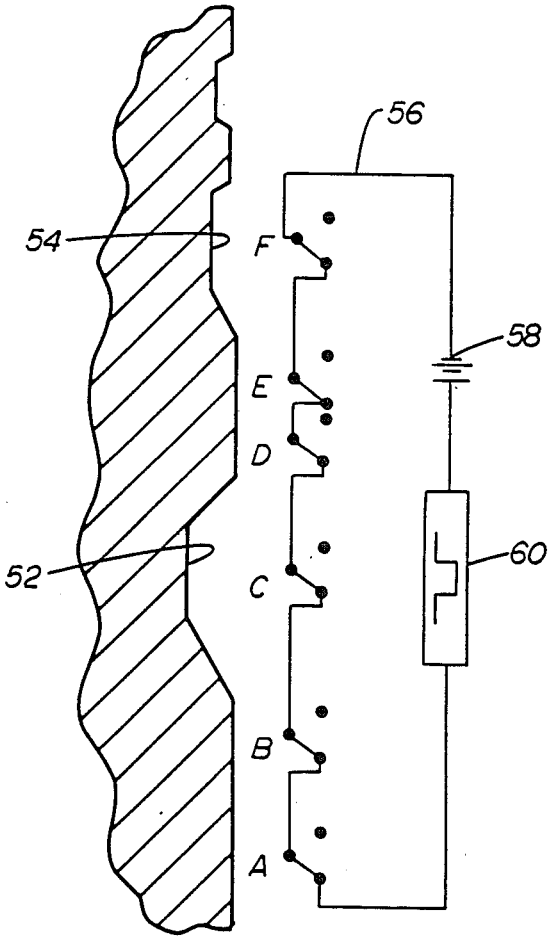
FIGS. 4A and 4B are schematic electric diagrams of the circuit used with the detection sub and its proximity detectors to provide an indication of the exact location and a partial sectional view of the interior grooves on the interior of the housing used to provide such indication is shown to the left of the schematic diagrams to illustrate the relative detector and groove locations.
Figure 4B:
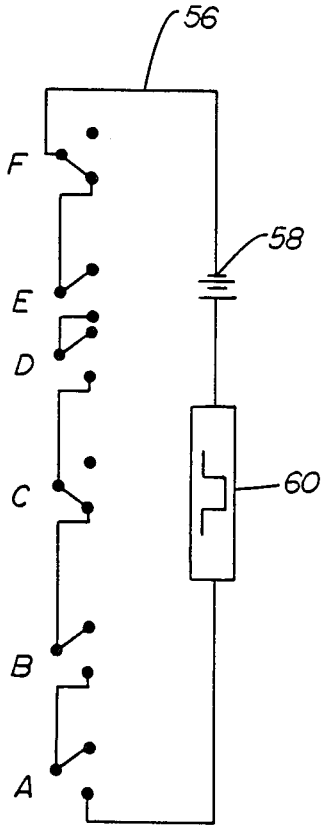

One of the sensing means 44 contemplated herein is illustrated in FIGS. 2 and 3. Means 44 is used to sense when the sub 46 is positioned exactly in a desired preselected position within housing 48. Sensing means 44 includes a plurality of proximity detector 50 which sense the closeness of the wall of housing 48. Sensing means 44 functions by the relative positions of each of detectors 50 with respect to grooves 52 and 54 on the interior of housing 48. As shown schematically in FIG. 2, there are six of detectors 50 positioned around the exterior of sub 46 and with each of detectors 50 is positioned at a different elevation in sub 46. While six of detectors 50 are shown, there could be fewer or more depending upon the complexity of the groove coding needed to positively identify the location. The levels are identified for each of the detectors 50 in FIG. 3 by the letters A, B, C, D, E, and F. The orientation of each of detectors 50 is identified in FIG. 2 by the same letters. The detectors 50 are identified by the same letters in FIGS. 4A and 4B. FIG. 4B illustrates the normal position of each of detectors 50. This normal position is A normally open, B normally open, C normally closed, D normally open, E normally open, F normally closed. In FIG. 4A the position of detectors 50 when sub 46 is in the desired preselected position within housing 48. When in this preselected position, detector A, being close to the inner wall of housing 48, is closed; detector B, being close to the inner wall of housing 48, is closed; detector C, being opposite groove 52, is closed; detector D, being close to the inner wall of housing 48, is closed; detector E, being close to the inner wall of housing 48, is closed; and detector F, being opposite groove 54, is closed. Thus in this position, all of detector 50 are closed and circuit 56, which includes all of detector 50 wired in series, suitable source of power 58 and acoustic generator 60, generates an acoustic signal as hereinafter explained.

Figure 5:
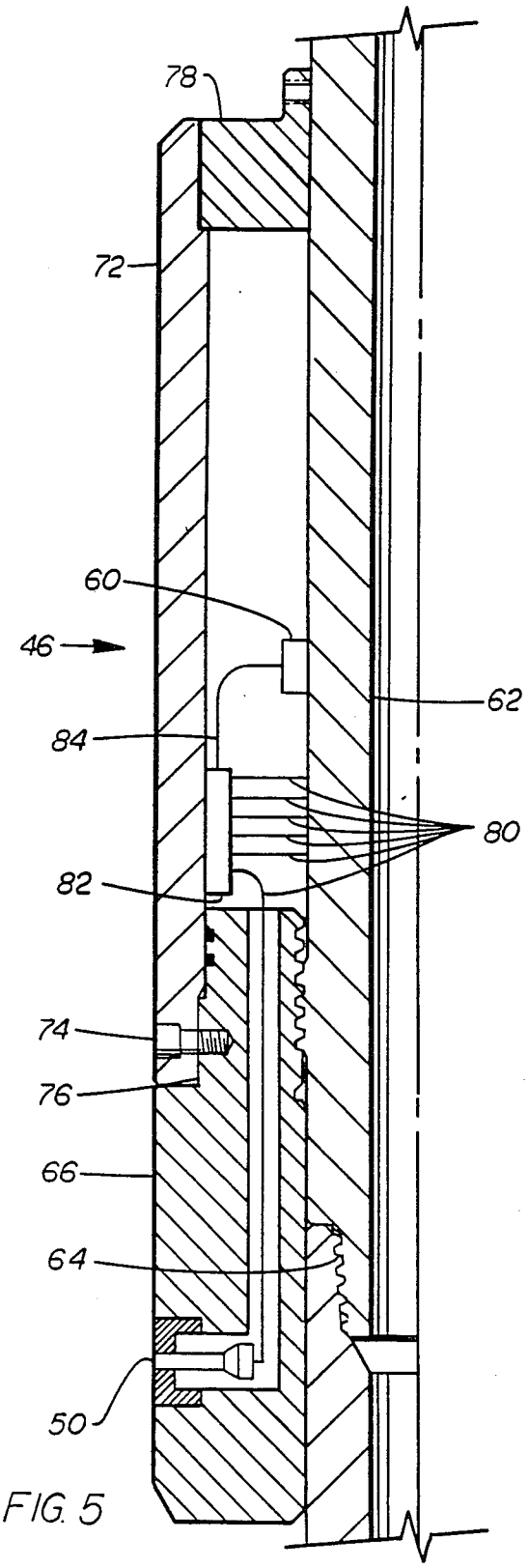
FIG. 5 is a partial sectional view of the detection sub shown in FIGS. 2 and 3 and further showing the means of transmitting the information out of the sub.

As shown in FIG. 5, sub 46 includes inner tubular mandrel 62 having lower threads 64 for engaging within string 66 and external threads 68 on which lower ring 70 is threaded, collar 72 which is secured by cap screws 74 to the recess 76 in the upper exterior of collar 72 and ring 78 which is positioned between the upper end of collar 72 and the exterior of mandrel 62. Circuit 56 includes wiring 80 from each of detectors 50, circuit control box 82, wiring 84 and acoustic generator 60. Acoustic generator 60 is secured to the exterior of tubular mandrel 62 so that the acoustic signal generated thereby is available to detected at sensor 86 positioned on collet collector 16, as shown in FIG. 1.

Figure 6:
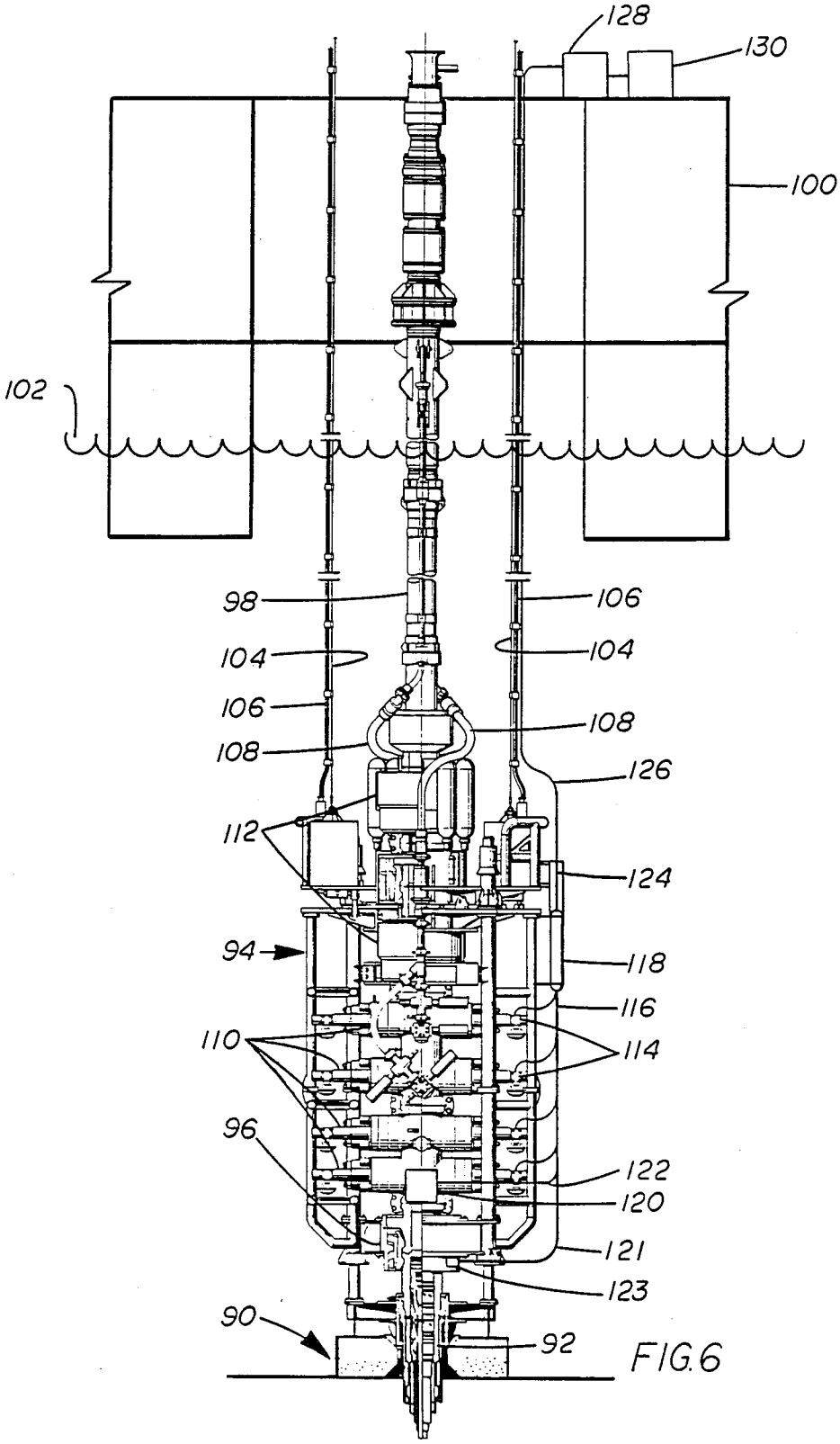
FIG. 6 is an elevation view of a subsea marine wellhead including the riser connection to the surface. This view schematically illustrates a plurality of operations which can be detected as hereinafter described and transmitted directly to the surface through wiring associated with the tube bundles extending from the surface to the wellhead.

FIG. 6 discloses subsea wellhead 90 which is similar to wellhead 10 and includes housing 92 to which stack 94 is connected by collet connector 96. Riser 98 connects from the upper end of stack 94 to floating structure 100 at water surface 102. Guide cables 104 also extend from stack 94 to floating structure 100 and wiring bundles 106 are secured to guide cables 104 to connect between structure 100 and stack 94 to provide control of stack 94 other components of wellhead 90. Choke and kill lines 108 extend upward along the exterior of riser 98. Stack 94 includes a plurality of ram type blowout preventers 110 and upper annular blowout preventer 112. Sensing means 114 are provided in one of the tailstocks of each of the preventers 110 for sensing the position of the rams in the preventers and lines 116 extend from such sensing means 114 to female stab-in connector 118. Additionally, sensing means 120 is mounted in the choke and kill connection on one side of the lower preventer 110 and line 122 extends from sensing means 120 to connector 118. Sensing means 123 is positioned on the exterior of connecter 96. Wiring 121 connects sensing means 123 to connector 118. The lower portion of riser which is lowered into position on the top of stack 94 includes male stab-in connector 124 which is adapted to seat within female connector 118 carried at the side of stack 94. Wiring 126 extends from male stab-in connector 124 upward with guide cable 104 with wiring bundles 106 to data processor 128 and indicating means 130 on floating structure 100. In this manner the data such as the position of the rams in each of the blowout preventers 110 and any other sensed position as previously described or hereinafter described and detected by sensing means 120 is transmitted to the surface on a direct wire connection and displayed on indicating means 130.

Figure 7:
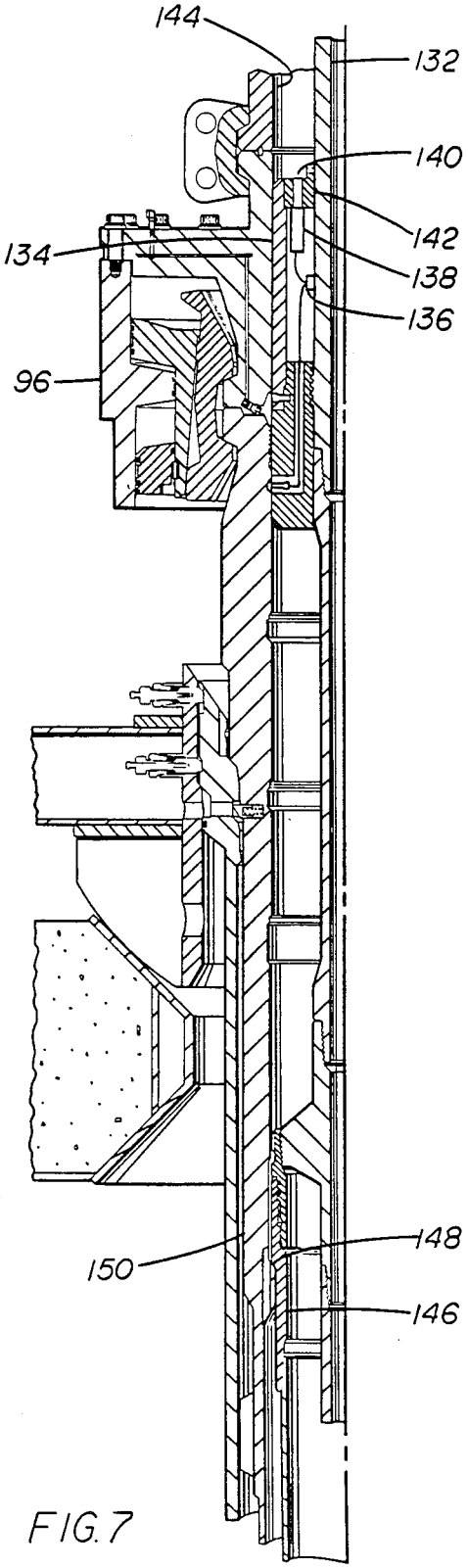
FIG. 7 is another partial sectional view of the subsea marine wellhead illustrating the landing of the hanger on the housing shoulder and the sub having the landing detector therein.

Wellhead 90 is illustrated in greater detail in FIG. 7 and includes string 132 with sub 134 mounted therein. Sub 134 is similar to sub 46 described above and includes acoustic detecting means 136 therein which is connected to acoustic generator 138 which is mounted to transmit acoustic signals through opening 140 in upper ring 142 into the fluid in annulus 144 surrounding string 132. Hanger 146 is supported on string 132 below subs 134. Hanger 146 is lowered on string 132 and is to be landed on landing seat 148 within housing 150. Acoustic detecting means 136 is adapted to detect the acoustics of the landing of hanger 146 on the landing seat 148 to provide a positive indication at the surface of the successful landing. The acoustic signal which is transmitted by acoustic generator 138 can be detected by sensing means 120 which is mounted on the choke and kill opening on the lower blowout preventer 110 or by sensing means 123 on connecter 96.

Figure 8:
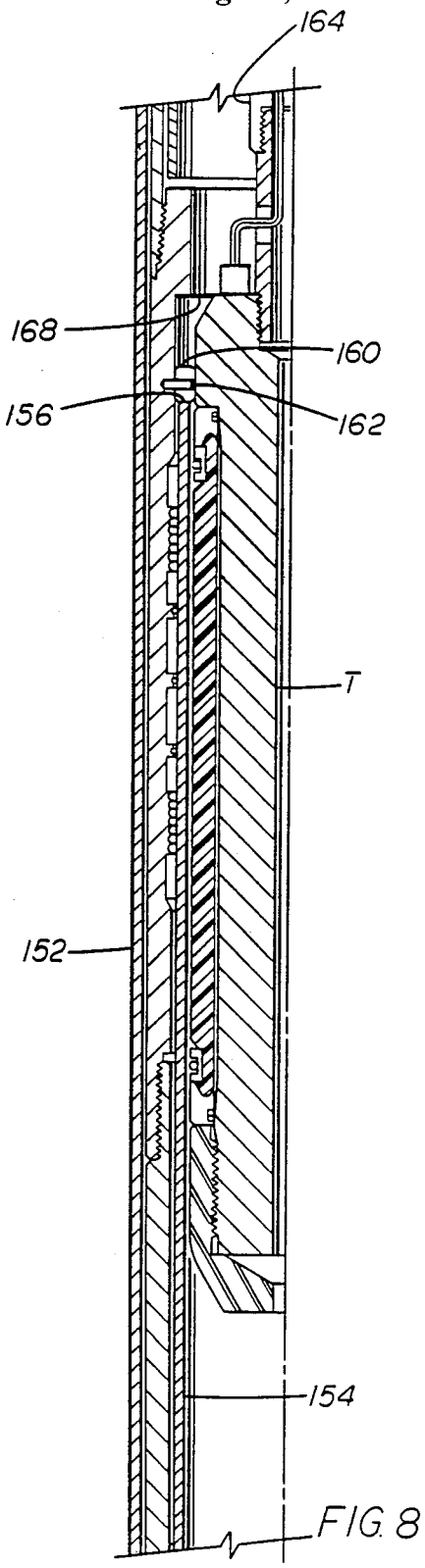
FIG. 8 is a partial sectional view of a tool used to cold forge a tubular member within an annular member and having means providing a noise or other type of acoustic wave responsive to the landing of the tool in its proper position. In the drawing of this FIGURE the tool carries a shear pin which has landed on the upper edge of the tubular member in the well but has not sheared.
Figure 9:
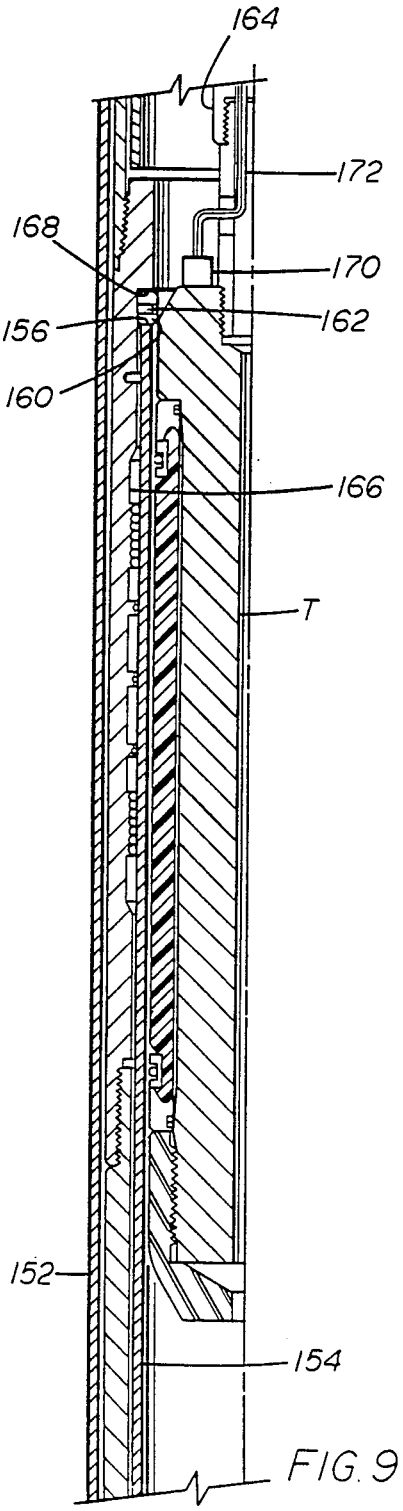
FIG. 9 is another partial sectional view illustrating the landing of the tool shown in FIG. 8 and the shearing of the shear pin which creates the acoustic wave which can be detected to indicate the landing.

Wall casing 152, shown in FIGS. 8 and 9, has string 154 positioned therein with the upper end of string indicated at 156 and housing 158 has been lowered into the space between casing 152 and string 154 and ring 160, which is secured to the interior of housing 158 by shear pins 162, is engagement with the upper end 156 of string 154. Cold forging tool T is positioned within string 154 and both tool T and housing 158 are supported on running string 164. The interior of housing 158 includes interior recess 166 having a forging profile to provide a tight gripping and sealing engagement between string 154 and the interior of housing 158 after the forging step. With ring 160 positioned on upper end 156 of string 154 as shown in FIG. 8, additional weight is put on housing 158 sufficient to shear pins 162. After pins 162 have been sheared housing 158 is lowered until ring, which is seated on end 156 is in supporting engagement with downwardly facing internal shoulder 168. This position is shown in FIG. 9 and the cold forging step may then be initiated. It should be noted that the acoustic waves generated by the shearing of pins 162 are detected by sensing means 170 positioned on the upper end of tool T and such data is transmitted through wiring 172 to be delivered either directly or otherwise to the floating structure on the water surface. Also, a suitable sensor could be used to detect such shearing of the pins 162 either in the location of sensing means 122 or 123 as illustrated in FIG. 6.

As used herein the term "well component" shall means and include the following components: casing, tubing, casing and tubing hangers, seals, latches, locking assemblies and other similar structures which are lowered to a position within a subsea wellhead and whose position or the occurrence of a condition with respect thereto is to be detected and transmitted to the surface to provide an indication that such component has achieved its desired position or condition.

Figure 10:
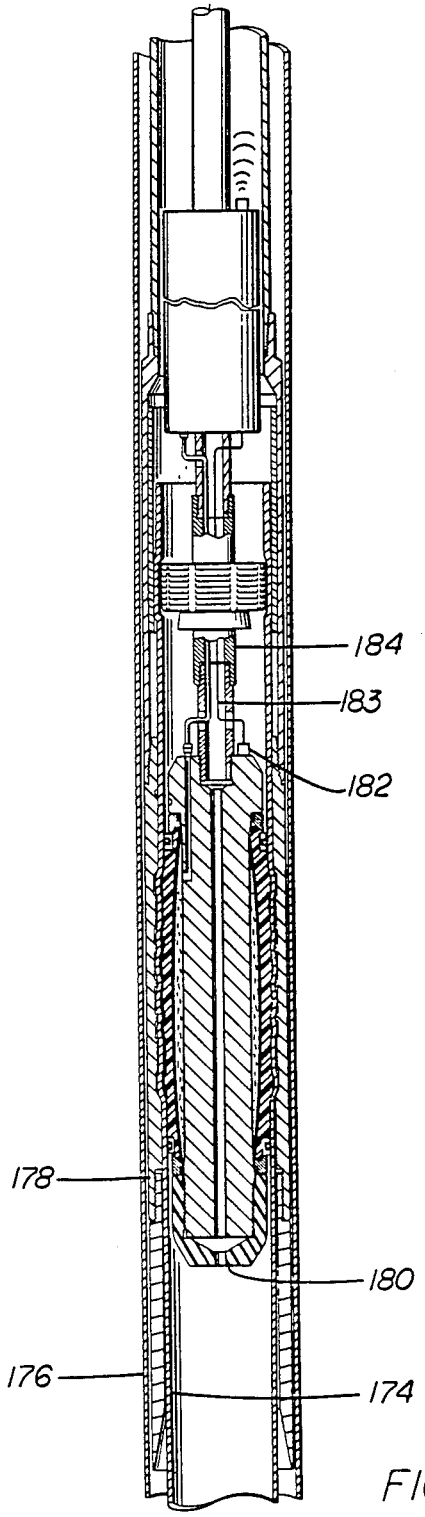
FIG. 10 is a longitudinal sectional view through the cold forging tool shown in FIGS. 8 and 9 after it has forged the tubular member into the annular member and showing the means for detecting the completion of the cold forging step.

As shown in FIG. 10, the completion f the cold forging step in forging the upper end of a string 174 positioned in a casing string 176 into housing 178 by the cold forging tool 180 can be detected by sensing means 182 positioned on tool 180. Sensing means 182 is connected by suitable wiring 186 up through string 184 which supports tool 180 to a suitable location for transmission to the surface. Sensing means 182 may be an acoustic receiver which listens for the acoustic waves which are given off by the deformation of the housing 178 as the cold forging step is completed or it could be the specific noise given off by a ring of brittle plastic which is mounted in a groove around the exterior of housing 178.

Figure 12:
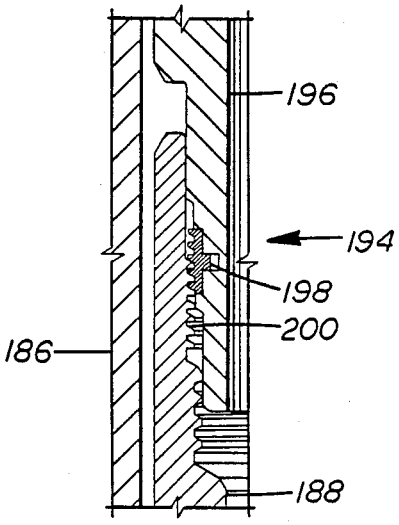
FIG. 12 is a detail sectional view of the latch mechanism in its initial stages of its ratcheting movement.
Figure 13:
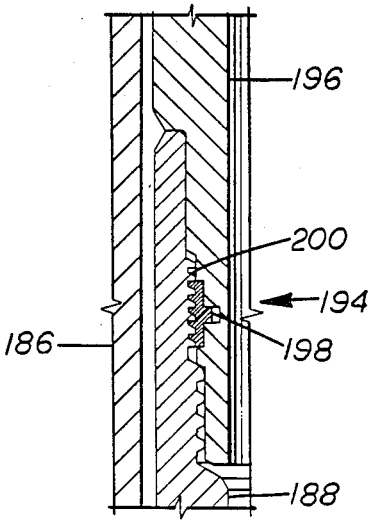
FIG. 13 is another detail sectional view of the latch mechanism on the completion of its ratcheting movement.
Figure 11:
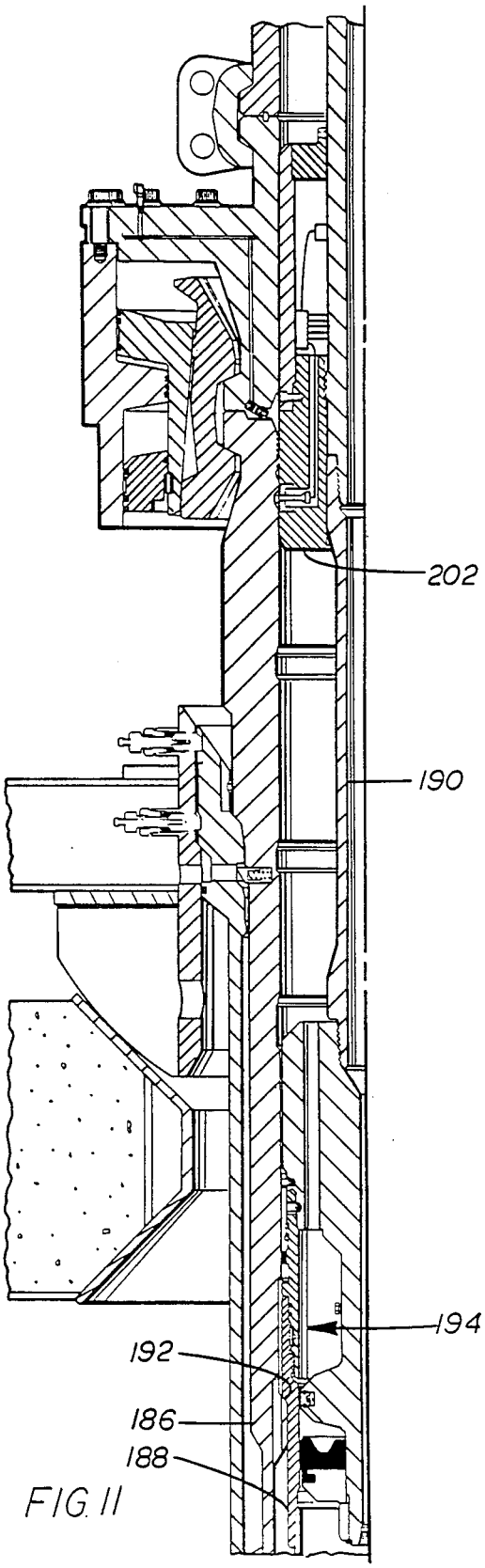
FIG. 11 is a partial longitudinal sectional view of the wellhead illustrating the landing of the seal assembly and the ratcheting of the latch mechanism and the detecting means for sensing that the latch has reached the end of its ratcheting.

Another system of determining the landing of a string and the setting of the ratcheting latch mechanism is illustrated in FIGS. 11, 12 and 13. Wellhead housing 186 is shown with hanger 188 supported from string 190 and landed on wellhead landing shoulder 192. Also, ratcheting latch mechanism 194 is positioned between the upper interior of hanger 188 and the exterior of sleeve 196 which moves to set latch mechanism 194. Latch mechanism 194 is shown in FIG. 12 with its latch element 198 in initial engagement with the ratchet teeth 200 on the interior of hanger 188. Subsequent movement of sleeve 196 moves latch element 198 downward to the position indicated in FIG. 13. Sub 202 is a detecting sub such as sub 46 illustrated in FIG. 5. Sub 202 functions to provide a surface indication of the landing of hanger 188 and the setting of the latch mechanism 194. Sub 202 is shown having a plurality of proximity detectors 204 which are positioned around sub body 206 at different levels to provide an indication of the position of subs 202 with respect to grooves 208 on the interior of housing 186.

Figure 14:
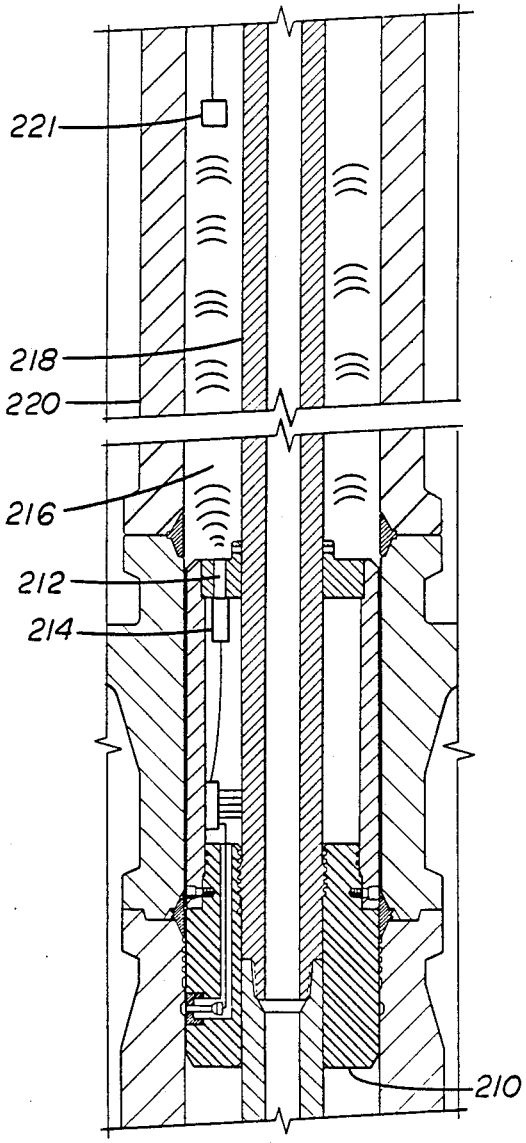
FIG. 14 is a sectional view of the detecting sub and the string on which it is run within the riser and indicating the means by which the sensed condition is transmitted to the surface through the fluids in the annulus between the string and the riser.
Figure 15:
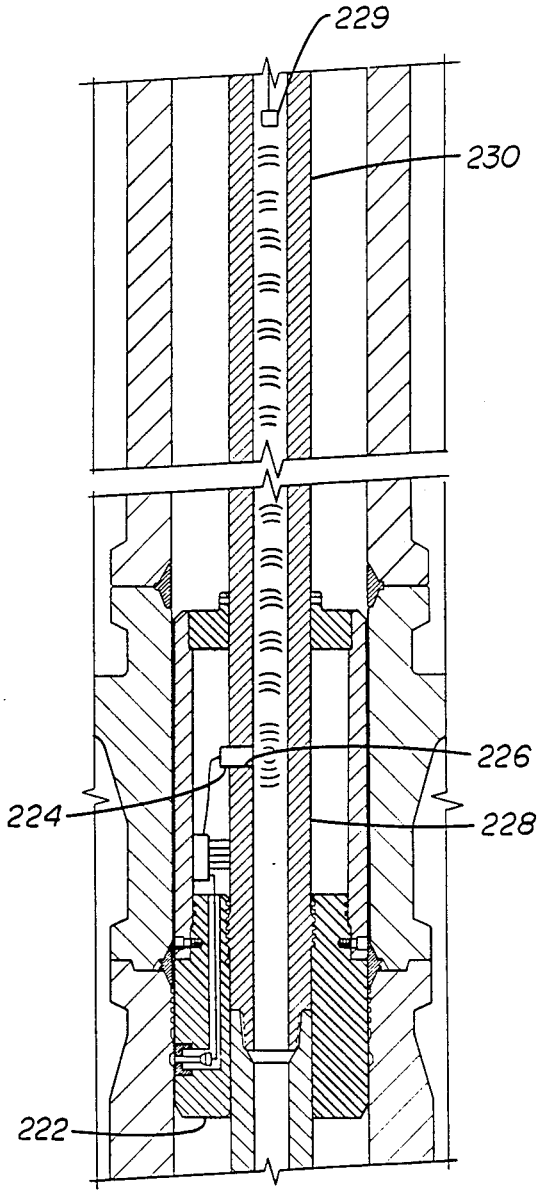
FIG. 15 is another sectional view similar to FIGURE 14 but illustrates the sensed condition being transmitted to the surface through the fluids in the string.
Figure 16:
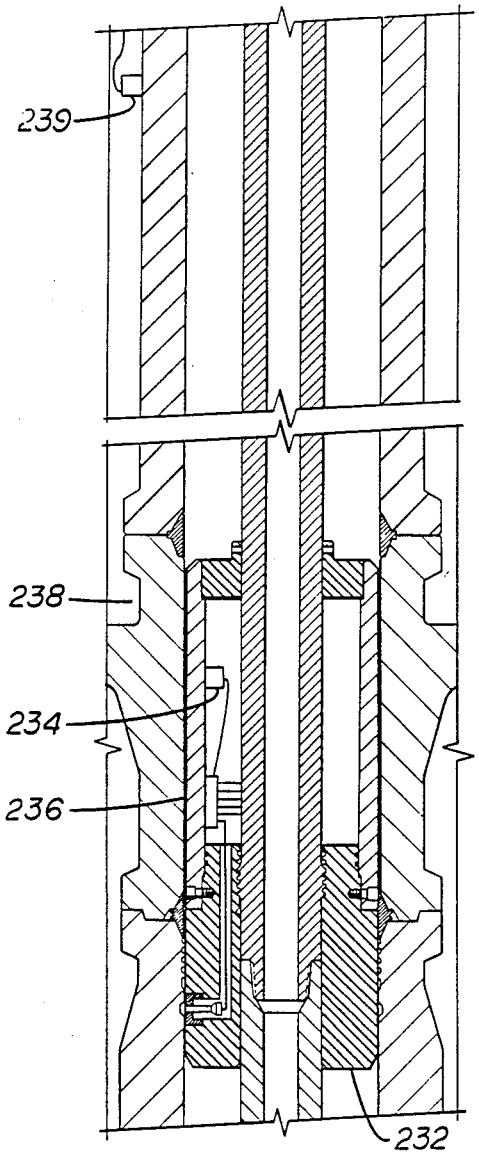
FIG. 16 is another sectional view similar to FIGS. 14 and 15 and illustrates the sensed condition being transmitted through the riser to the surface.
Figure 17:
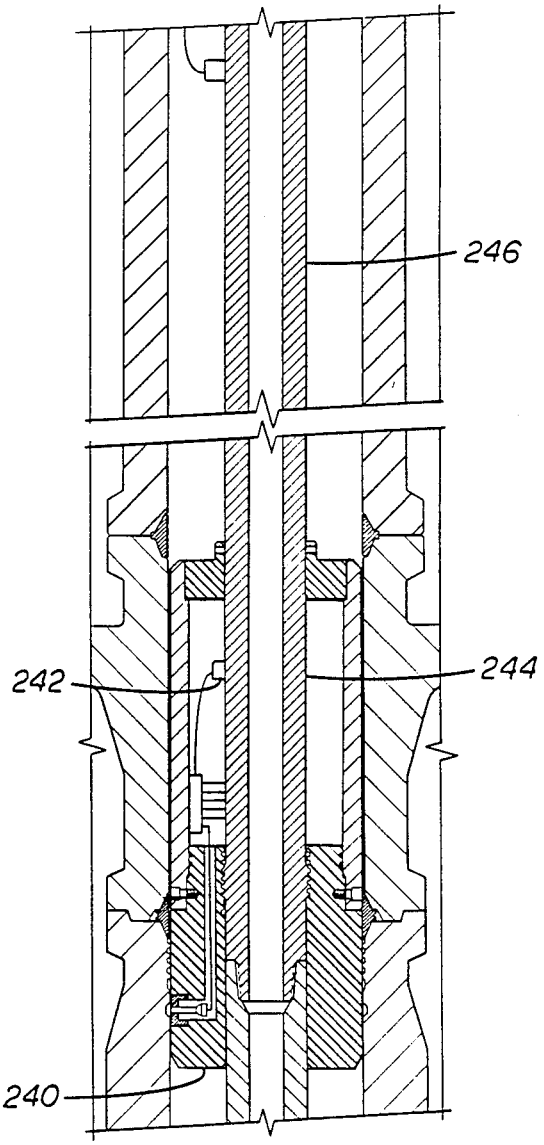
FIG. 17 is another sectional view similar to FIGS. 14, 15 and 16 and illustrates the sensed condition being transmitted through the string to the surface.

FIGS. 14, 15, 16, and 17 illustrate the different means of transmitting data detected by a position detecting sub. In FIG. 14 sub 210 is a position location sub using proximity detectors and the data is transmitted from sub through opening 212 in the upper ring of sub 210 by directing the output of acoustic generators 214 through such opening 21 and into the fluid within the annulus 216 between sub string 218 and housing 220. Detector 221 positioned in the upper end of annulus 216 receives the transmitted signal. In FIG. 15 sub 222 has acoustic generator 224 which is positioned at opening 226 in sub mandrel 228 to transmit the acoustic signal through the fluids in the bore of mandrel 228 and string 230 above mandrel 228. Detector 229 positioned within the interior of the upper portion of string 230 detects the signal. Sub 232, shown in FIG. 16, transmits the signal generated by acoustic generator 234 which is positioned against the collar 236 and up through housing 238. Detector 239 is secured to the exterior of the upper end of housing 238 detects the signal sent therein. Sub 240 of FIG. 18 is similar in that its acoustic generator 242 is secured against the exterior of sub mandrel 244 so that the signal is transmitted upward through the central portion of string 246 and is received by detector 248 secured to the exterior of string 246.

What is claimed is:

1. The method of conducting operations within a subsea wellhead of a subsea marine well from the water surface including the steps of lowering a well component into the subsea wellhead on a running string, lowering detecting equipment and transmission equipment into the subsea wellhead on the running string, detecting the occurrence of a condition with respect to said well component within the subsea wellhead, and transmitting a signal responsive to the detection of the condition to the water surface.

2. The method according to claim 1 including the step of displaying at the water surface an indication of the occurrence of the condition of the well component responsive to the receive of the transmitted signal.

3. The method according to claim 1 wherein the condition of the well component within the subsea wellhead can be detected acoustically.

4. The method according to claim 1 wherein said detection step detects the acoustic wave generated by the condition of the well component within the subsea wellhead.

5. The method according to claim 1 including the step of generating an acoustic wave responsive to the detected condition of the well component within the subsea wellhead.

6. The method according to claim 1 wherein said detecting step includes the step of detecting strain in the well component within the subsea well.

7. The method of controlling subsea marine wellhead operations from the water surface including the steps of manipulating a string at the water surface to lower a detecting means, a transmitter and a well component into a desired position within the subsea wellhead, detecting the achievement of the desired position by the well component within the subsea wellhead, transmitting to the water surface a signal responsive to the detection of the achievement of the desired position by the well component, and indicating at the water surface the position of the well component within the subsea wellhead.

8. The method according to claim 7 wherein said well component is hanger and said desired position is the landing of the hanger on a landing shoulder within the subsea wellhead.

9. The method according to claim 7 wherein said well component is a hanger having an annulus seal and said desired position is the setting of the annulus seal.

10. The method according to claim 1 wherein said well component includes a ratcheting latch mechanism and said desired position is the ratcheting and setting of the ratcheting latch mechanism within the subsea wellhead.

11. The method according to claim 7 wherein said well component is a tubular member and said desired position is the completion of the cold forging of the tubular member into tight gripping and sealing engagement within another member within said subsea wellhead.

12. The method according to claim 8 wherein said detecting step includes detecting the noise of the landing of the hanger on the landing shoulder.

13. The method according to claim 7 wherein said detecting step includes detecting the position with a ferrous metal proximity switch detector.

14. The method according to claim 13 wherein said ferrous metal proximity switch detector creates a preselected acoustic output pattern when the landing is complete and the detecting step includes detecting the preselected acoustic output pattern of said proximity switch.

15. The method according to claim 7 wherein said detecting step includes generating an acoustic output for detection upon the occurrence of said desired position.

16. The method according to claim 7 wherein said transmitting step includes transmitting through the water by sonar.

17. The method according to claim 7 wherein said transmitting step includes transmitting the signal through the subsea wellhead equipment.

18. The method according to claim 7 wherein said transmitting step includes transmitting the signal through the string extending from the water surface to the interior of the wellhead equipment.

19. The method according to claim 7 wherein said transmitting step includes transmitting the signal through a wire.

20. An apparatus for manipulating equipment including a well component in a subsea wellhead of a subsea marine well comprising detecting means for detecting the occurrence of a condition with respect to said well component within the subsea wellhead, transmitting means for transmitting a signal to the water surface, means for supporting the detecting means and the transmitting means on the running string with the well component, a running string for lowering the well component, said detecting means and said transmitting means into the subsea marine well, said detecting means upon the detection of the occurrence of a condition with respect to said well component within the subsea wellhead causing said transmitting means to transmit a signal to the water surface that the condition has occurred.

21. An apparatus according to claim 20 including means at the water surface for receiving the transmitted signal, and means at the water surface for displaying the occurrence of the condition with respect to the well component.

22. An apparatus according to claim 20 wherein said detecting means is an acoustic sensor.

23. An apparatus according to claim 20 including means for generating an acoustic signal responsive to the detection of the occurrence of the condition.

24. An apparatus according to claim 20 wherein said detection means detects the level of strain in the well component within the subsea wellhead to determine the occurrence of the condition with respect to the well component.

25. An apparatus according to claim 20 wherein said running string includes a sub, the wellhead includes a housing having internal lands and grooves, said condition is the well component reaching a desired position within said subsea wellhead, and said detecting means includes a plurality of proximity detectors mounted at different levels in said sub on the running string with the detectors coacting with lands and grooves on the interior of the wellhead housing to determine the reaching of such desired position by said well component.

26. An apparatus according to claim 20 wherein said transmitting means is a sonar transmitter facing upwardly toward the water surface and positioned within the water to one side of the subsea wellhead.

27. An apparatus according to claim 20 wherein said transmitting means is an acoustic generator.

28. An apparatus according to claim 20 including wiring connecting said transmitting means to the water surface.

29. An apparatus according to claim 21 wherein said display means includes a data processor for processing the data received from the subsea wellhead, and an indicator to display the results of the processed data.

* * * * *